US007793646B2

(12) United States Patent
Cooper et al.

(10) Patent No.: US 7,793,646 B2
(45) Date of Patent: Sep. 14, 2010

(54) BOWSTRING SUPPRESSION DEVICE

(75) Inventors: Darin B. Cooper, Layton, UT (US); Gideon S. Jolley, Syracuse, UT (US); Randy J. Walk, Erda, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 447 days.

(21) Appl. No.: 11/770,591

(22) Filed: Jun. 28, 2007

(65) Prior Publication Data

US 2009/0000606 A1 Jan. 1, 2009

(51) Int. Cl.
*F41B 5/20* (2006.01)

(52) U.S. Cl. ..... 124/89; 124/86

(58) Field of Classification Search ..... 16/86 R, 16/86 A, 86 B, 86 C; 124/23.1, 25.6, 86, 124/88, 89; 267/139, 140, 153
See application file for complete search history.

(56) References Cited

U.S. PATENT DOCUMENTS

| | | | | | |
|---|---|---|---|---|---|
| 1,613,077 | A | * | 1/1927 | Bourgon | 224/42.39 |
| 2,189,048 | A | * | 2/1940 | Underhill | 16/86 A |
| 2,596,780 | A | * | 5/1952 | Meyers et al. | 267/140 |
| 4,061,125 | A | | 12/1977 | Trotter | |
| 4,429,068 | A | * | 1/1984 | Nakahira | 524/302 |
| 5,146,908 | A | | 9/1992 | Larson | |
| 5,362,046 | A | | 11/1994 | Sims | |
| 5,452,704 | A | | 9/1995 | Winebarger | |
| 5,651,355 | A | | 7/1997 | Gallops, Jr. | |
| 5,718,213 | A | | 2/1998 | Gallops, Jr. et al. | |
| 5,720,269 | A | | 2/1998 | Saunders | |
| 6,152,124 | A | | 11/2000 | Gallops, Jr. | |
| 6,237,584 | B1 | | 5/2001 | Sims | |
| 6,425,385 | B1 | | 7/2002 | Gallops, Jr. | |
| 6,499,478 | B1 | | 12/2002 | Perez | |
| 6,550,467 | B2 | | 4/2003 | Gallops, Jr. | |
| 6,634,348 | B2 | | 10/2003 | Gallops, Jr. | |
| 6,966,314 | B2 | | 11/2005 | McPherson | |
| 2003/0056779 | A1 | | 3/2003 | Gallops, Jr. | |
| 2003/0056780 | A1 | | 3/2003 | Gallops, Jr. | |
| 2006/0278207 | A1 | * | 12/2006 | Goade | 124/89 |
| 2008/0141993 | A1 | * | 6/2008 | Goade | 124/89 |
| 2008/0236559 | A1 | * | 10/2008 | Barnard | 124/89 |

* cited by examiner

*Primary Examiner*—John Ricci
(74) *Attorney, Agent, or Firm*—Holland & Hart

(57) ABSTRACT

A bowstring suppression device can be coupled to a bow to reduce the sound produced by the bowstring when the bow is drawn and released. The bowstring suppression device may include a cushion portion that is positioned adjacent to the bowstring when the bow is in an undrawn configuration. When the bow is drawn and released, the bowstring contacts the bowstring suppression device thereby deadening residual movement of the bowstring and reducing the sound generated by the bowstring.

34 Claims, 13 Drawing Sheets

BOWSTRING SUPPRESSION DEVICE

BACKGROUND

Bowhunting in particular is enjoyed by many individuals and families because of the unique challenges it presents. Archery bows can be used to hunt a wide variety of game from rodents to moose. One problem encountered when hunting with a bow is the sound produced when the bowstring is released and the arrow is launched. The sound is sometimes referred to as the "twang" of the bow. Although the sound does not affect the accuracy of the arrow, the sound travels faster than the arrow and can startle game before the arrow reaches the game. This may result in the game jumping so that the arrow hits the game in the wrong spot or the game may escape entirely.

Over the years, numerous methods and devices have been proposed to reduce the noise produced by the bowstring. One popular type of devices are those that couple directly to the bowstring and have numerous relatively loose pieces of rubber-like material that dampen bowstring vibrations. Although these devices work to reduce the sound, there is still a noticeable twang when the bowstring is released. It would be desirable to reduce the sound from the bowstring further. Accordingly, various improved bowstring dampening devices are shown herein.

SUMMARY

Bowstring suppression devices are provided that reduce the sound generated by the bowstring of a bow when it is released. In one embodiment, the bowstring suppression device includes a first end that is configured to be coupled to the bow, preferably to the riser of the bow. The bowstring suppression device extends outward from the bow toward the bowstring. A second end of the bowstring suppression device is positioned adjacent to (spaced slightly apart from or in contact with) the bowstring when the bow is in an undrawn state.

The second end of the bowstring suppression device includes a cushion portion. When the bowstring is released, the bowstring contacts the cushion portion to thereby deaden residual movement of the bowstring and, consequently, reduce the amount of sound generated by the bowstring. In one embodiment, the cushion portion may have one or more holes in the side to further cushion contact between the bowstring and the bowstring suppression device. The holes may be positioned underneath where the bowstring contacts the cushion portion. In another embodiment, the cushion portion may have a channel that is configured to receive the bowstring when the bowstring contacts the cushion portion. In yet another embodiment, the cushion portion may be curved outward where the bowstring contacts the cushion portion.

In another embodiment, the bowstring suppression device may be configured to capture and securely hold the bowstring after the bowstring is released. The bowstring suppression device may include a stop member that is configured to receive the impact of the bowstring. The stop member may be configured to rotate upon impact with the bowstring and hold the bowstring to prevent and/or reduce undesirable residual movement of the bowstring.

The bowstring suppression device may be configured to be used with any bow. In one embodiment, the bowstring suppression device may be configured to be used with a compound bow. In other embodiments, the bowstring suppression device may be configured to be used with a recurve bow, long bow, crossbow, or the like. The bow may also include other vibration dampening devices attached to the bowstring, limbs, riser: quiver, and/or sight.

The foregoing and other features, utilities, and advantages of the subject matter described herein will be apparent from the following more particular description of certain embodiments as illustrated in the accompanying drawings.

DRAWINGS

DETAILED DESCRIPTION

Figure 1:
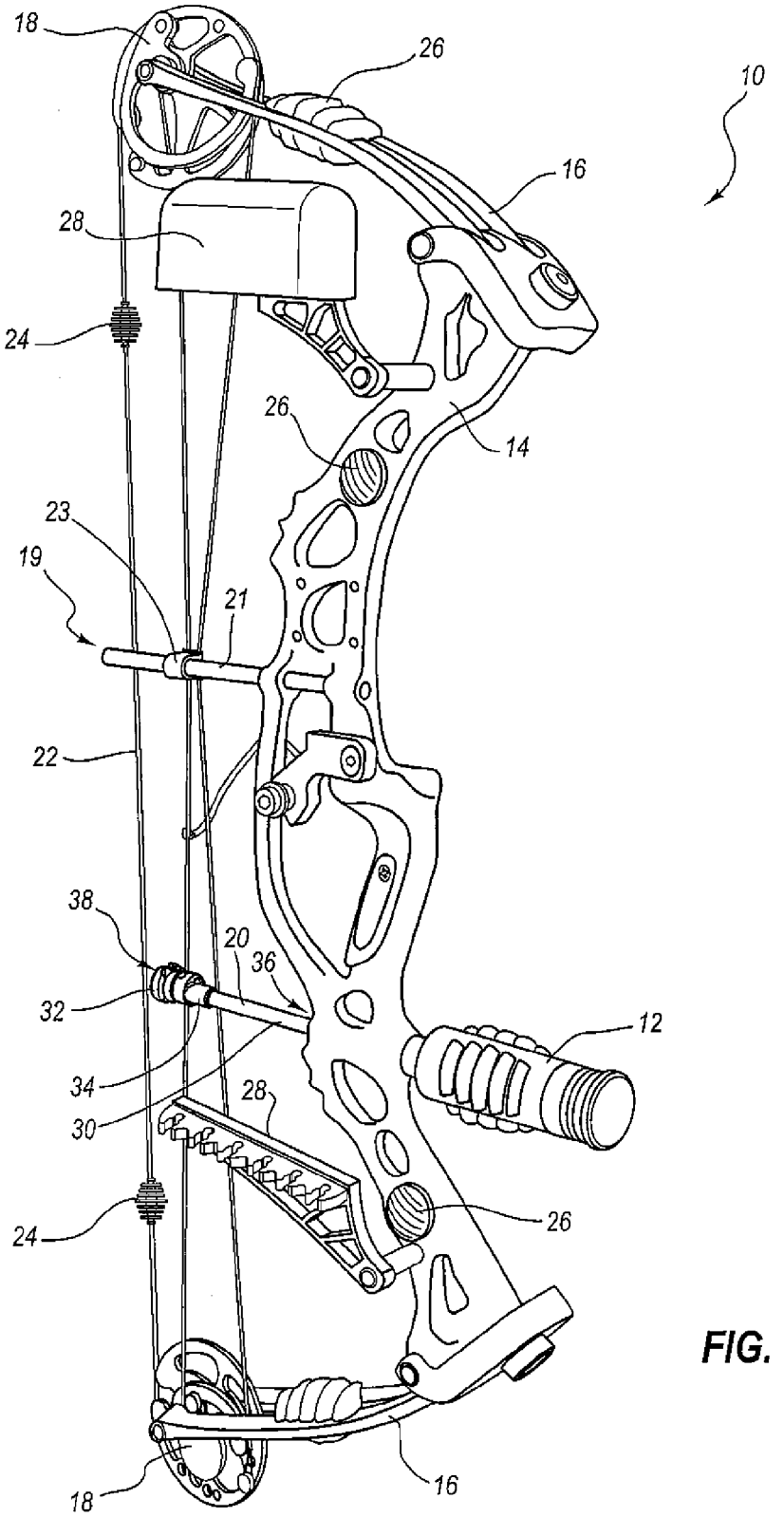
FIG. 1 is a perspective view of a bow having a bowstring suppression device.
Figure 2:
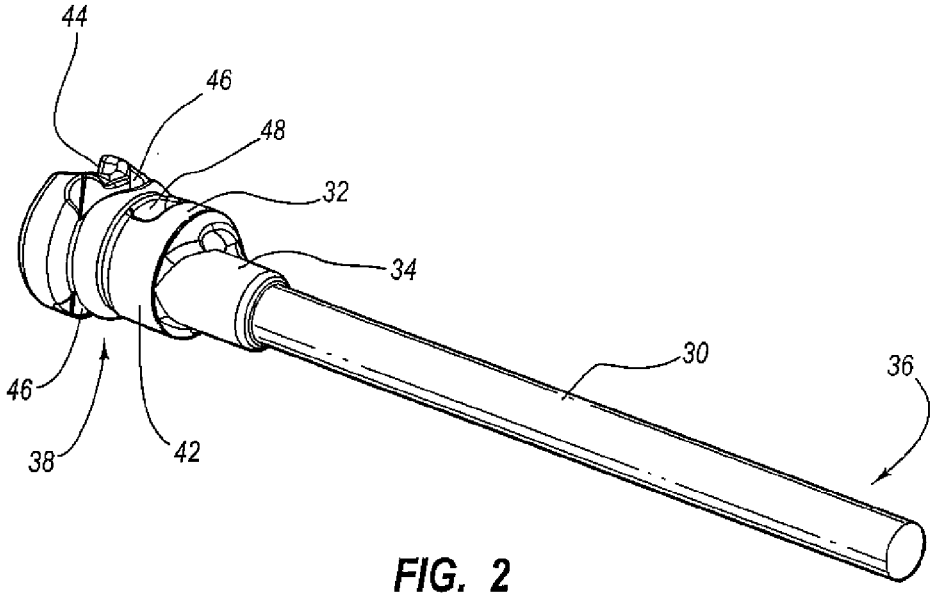
FIGS. 2-5 are various perspective views of the bowstring suppression device.
Figure 3:
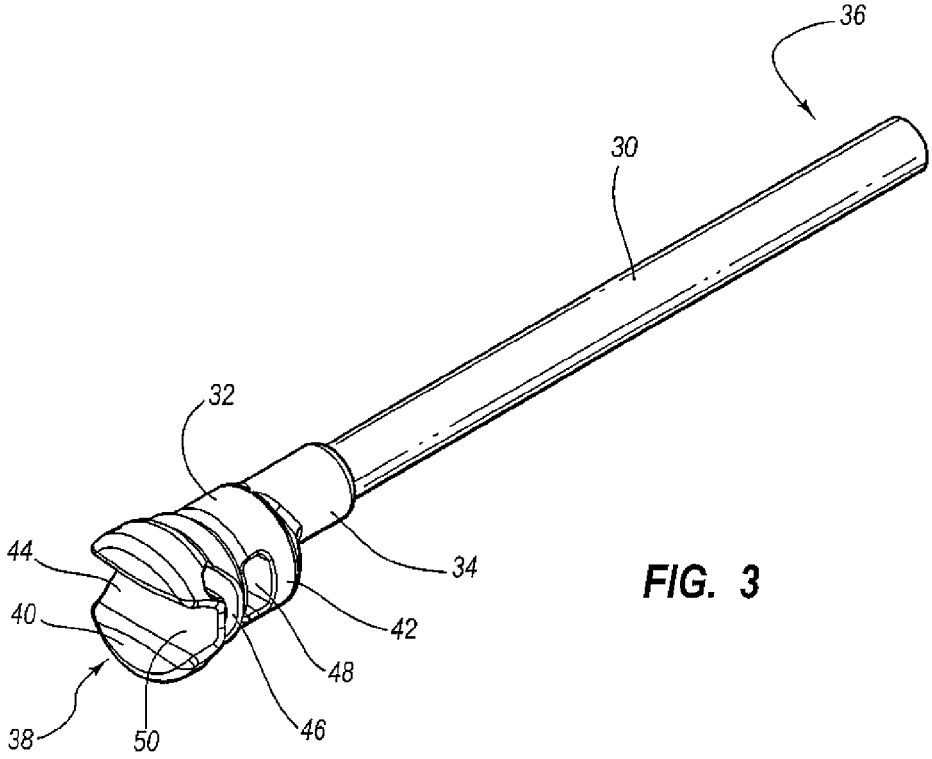
Figure 4:
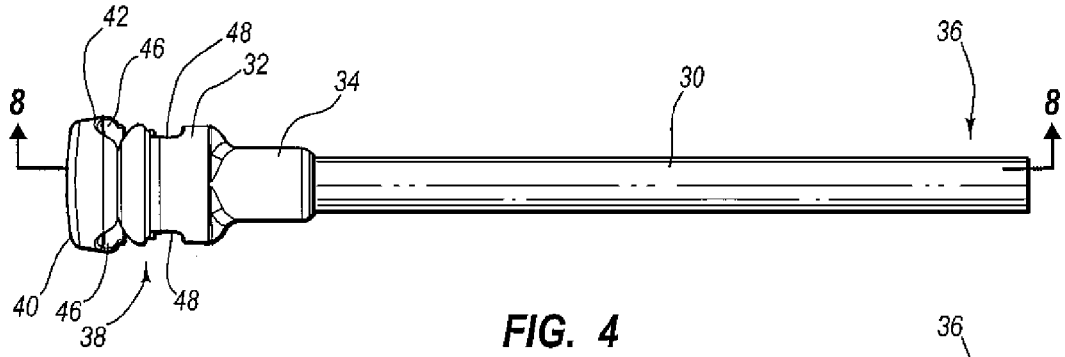

Referring to FIG. 1, an archery bow 10 is shown that includes a bowstring suppression device 20 (alternatively referred to herein as a bowstring stop, bowstring suppression apparatus, sound dampening device, or sound dampening apparatus), a stabilizer 12, a riser 14, limbs 16, cams 18, a cable guard assembly 19, and string 22. The cable guard assembly 19 includes a rod or shaft 21 and a cable slide 23. The bow 10 also includes bowstring dampeners 24 and various other vibration dampeners 26 to reduce the amount of noise generated when the string 22 is released. In addition, the bow 10 includes a quiver 28 capable of holding a plurality of arrows (not shown) within easy access of the user.

It should be appreciated that the bowstring suppression device 20 can be used with any suitable bow. The bow 10 is shown as one example of a type of bow that is suitable to be used with the bowstring suppression device 20. Other bows that can use the bowstring suppression device 20 include other compound bows, recurve bows, reflex bows, long bows, crossbows and the like.

The bowstring suppression device 20 includes a body 30 (alternatively referred to herein as a rod or shaft), a cushion portion 32 (alternatively referred to herein as a cushion member, stop member, stop portion, elastomeric member or portion, resilient member or portion, bowstring suppression member, or bowstring arrestor), and a coupler 34 used to couple the body 30 and the cushion portion 32 together. As shown in FIG. 1, a first end 36 of the bowstring suppression device 20 is coupled to the riser 14 of the bow 10. The body 30 extends rigidly outward from the bow 10. The cushion portion 32 is positioned at a second end 38 of the bowstring suppression device 20 adjacent to (i.e., spaced slightly apart from or in contact with) the bowstring 22 when the bow 10 is in an undrawn configuration. The cushion portion 32 is positioned so that when the bow 10 is drawn and released, the bowstring 22 contacts the cushion portion 32 to thereby deaden residual movement of the bowstring 22.

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

It should be appreciated that although the bowstring suppression device 20 is shown coupled to the riser 14 of the bow 10, the bowstring suppression device 20 can also be coupled to any suitable component of the bow 10 such as one of the limbs 16. Furthermore, the bowstring suppression device 20 may be positioned below a grip of the bow 10, as shown in FIG. 1, or above the grip of the bow 10. Also, it should be appreciated that the bowstring suppression device 20 may extend outward so that the cushion portion 32 is close to or in contact with the bowstring 22 when the bow 10 is in an undrawn configuration. In another embodiment, the bow 10 may have a plurality of bowstring suppression devices 20 coupled to it. For example, a bowstring suppression device 20 may be coupled to the riser 14 above the handle and below the handle.

Referring to the drawings, it should be noted that the bowstring suppression device 20 may be configured as a rigid device without any moving parts or components other than the compression experienced by the cushion member 32 when the bowstring 22 contacts it. A rigid unmoving configuration may be desirable from a number of standpoints such as cost, complexity, and durability, to mention just a few. However, it should also be appreciated that the bowstring suppression device 20 may be configured to be movable. For example, the bowstring suppression device 20 may be adjustable lengthwise to allow the bowstring suppression device 20 to fit different sized bows.

The bowstring suppression device 20 may be made from any suitable material(s). In general, however, the material(s) should allow some give to absorb the impact of the bowstring 22. At the same time, the material(s) should also be sufficiently stiff or rigid to impede residual movement of the bowstring 22 and thereby reduce the noise produced by the bowstring 22. In one embodiment, the body 30, the cushion portion 32, and the coupler 34 may be formed as a single unitary piece of material (e.g., resilient rubber material). In another embodiment, the body 30, the cushion portion 32, and the coupler 34 may be made of separate materials. For example, the body 30 may be made of a carbon fiber based material, the coupler 34 may be made of a suitable plastic material, and the cushion portion 32 may be made of a resilient material. Each material may be coupled together using adhesive or any other suitable fastening material, device, or technique. In one embodiment, the cushion portion 32 may include a mixture of chloroprene and butyl polymers. One example of a product that has a suitable mixture of chloroprene and butyl polymers is NAVCOM, available from Sims Vibration Laboratory, Shelton, Wash. The properties of NAVCOM can be found in U.S. Pat. No. 6,237,584 (the properties and characteristics of NAVCOM being incorporated by reference herein from said patent).

Referring to FIGS. 2-7, the cushion portion 32 includes a front section or face 40 and one or more sides 42. It should be appreciated that referring to "the side" of the cushion portion 32 is intended to encompass all of the sides of the cushion portion 32, unless the context indicates otherwise. This understanding may be particularly applicable to situations where the cushion portion 32 is not round but is square, hexagonal, or some other suitable geometric shape.

The front section 40 includes a channel or groove 44 that extends across the front section 40. When the bowstring suppression device 20 is coupled to the bow 10, the channel 44 is aligned lengthwise with the bowstring 22 so that when the bowstring 22 contacts the front section 40, the bowstring 22 fits within the channel 44. The channel 44 prevents the bowstring 22 from slipping off the edge of the front section 40 when the bowstring 22 impacts the cushion portion 32.

The side of the cushion portion 32 includes a plurality of first holes or cavities 46 and a plurality of second holes or cavities 48. The first holes 46 and the second holes 48 are positioned opposite one another (i.e., the first holes 46 are opposite each other and the second holes 48 are opposite each other) and underneath the channel 44 formed in the front section 40. Due to the presence of the first holes 46, the front section 40 is unsupported at the edges where the bowstring 22 contacts the cushion portion 32. It is noted that the bottom of the channel 44 forms an impact surface 50 where the bowstring 22 contacts the cushion portion 32. In the FIGS., the holes 46 extend most of the way through the cushion portion 32. A small amount of material separates each hole 46 and provides support for the front section 40. In addition, the opposing sides of the cushion portion 32 that are positioned parallel to the bowstring 22 also support the front section 40. The second holes 48 are positioned on the side of the cushion portion 32 below the first holes 46. In other words, each of the first holes 46 is positioned in line with each of the second holes 48 so that the combination of each first hole 46 and each second hole 48 is generally parallel to a lengthwise axis of the bowstring suppression device 20.

Figure 5:
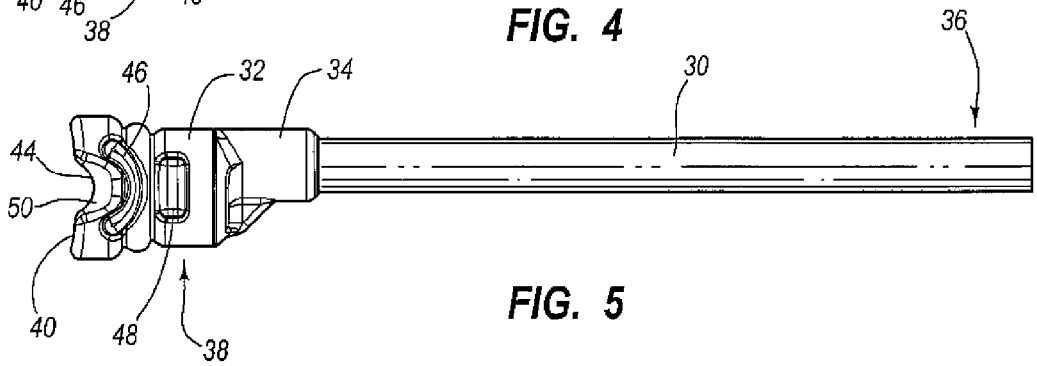
Figure 6:
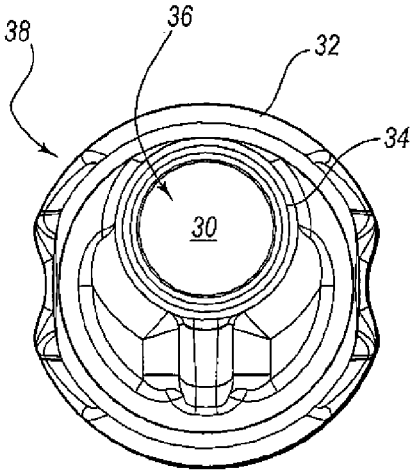
FIGS. 6-7 are end views of the bowstring suppression device.
Figure 7:
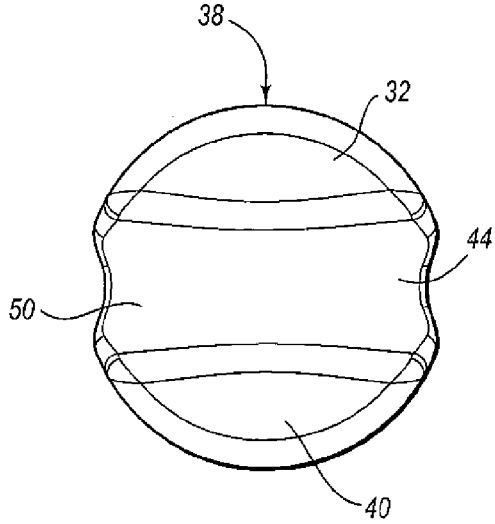
Figure 8:
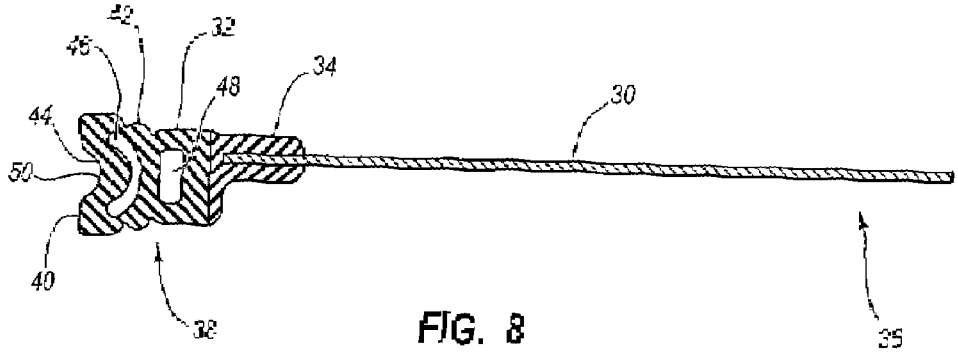
FIG. 8 is a cross-sectional view of the bowstring suppression device along lines 8-8 shown in FIG. 4.
Figure 9A:
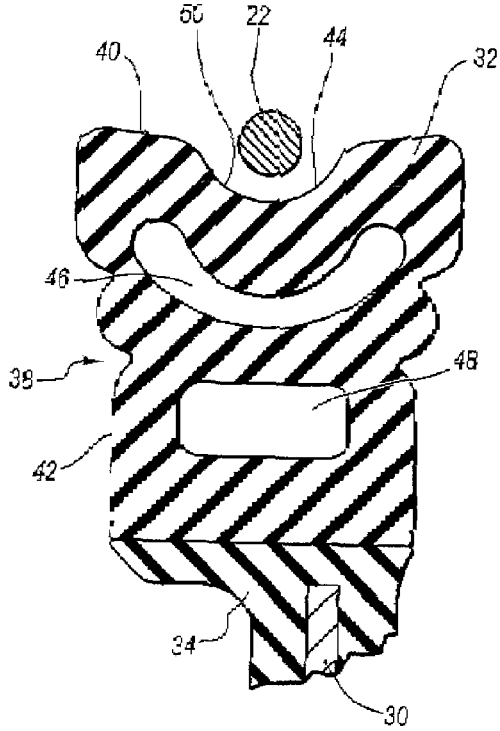
FIG. 9A is a cross sectional view of the bowstring suppression device positioned adjacent to a bowstring.
Figure 9B:
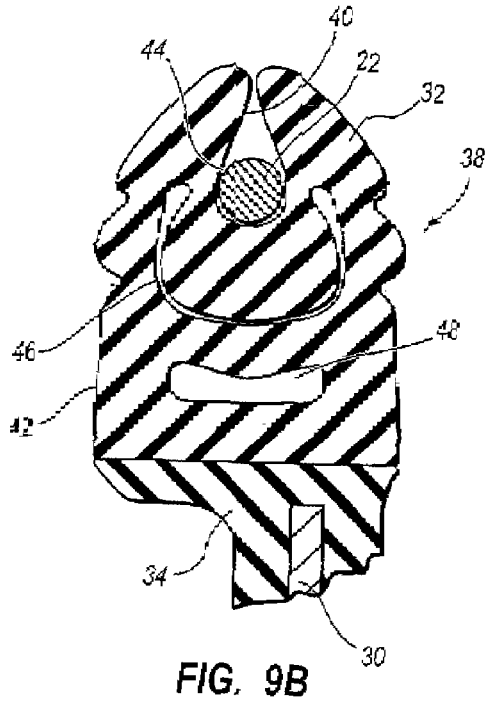
FIG. 9B is a cross-sectional view of the bowstring suppression device impacted by a bowstring.

The holes 46, 48 are strategically placed to provide the appropriate amount of cushion when the bowstring 22 strikes the bowstring suppression device 20. FIGS. 9A-9B illustrate the bowstring 22 impacting the cushion portion 32 of the bowstring suppression device 20. The impact of the bowstring 22 causes the edges of the front section 40 to collapse into the first holes 46 and to a lesser extent into the second holes 48. The impact surface 50 in the bottom of the channel 44 is curved or rounded outward as shown in FIG. 5. The curved shape of the impact surface 50 and the lack of support underneath the outer edges of the impact surface 50 due to the first holes 46 facilitates better absorption of the energy from the bowstring 22. The full impact of the energy from the bowstring 22 is absorbed by the entire length of the impact surface 50 in the channel 44.

In the embodiment shown in FIGS. 9A-9B, the cushion portion 32 of the bowstring suppression device 20 is configured to capture and hold the bowstring 22 for one or more cycles of movement of the bowstring 22. The presence of the holes 46, 48 underneath the impact surface 50 allow the bowstring 22 to collapse the cushion portion 32 along the channel 44 so that the cushion portion 32 holds the bowstring 22 for one or more cycles thereby dampening the impact and rebound motion of the bowstring 22.

Turning now to FIGS. 18-23, another embodiment of the bowstring suppression device 20 is shown. This embodiment is configured to allow the user to adjust the lateral position of the cushion portion 32. This is desirable to make the bowstring suppression device 20 suitable for use with a wide range of bow configurations and bows where the position of the bowstring varies relative to the location on the riser where the body 30 is mounted. For example, one bow configuration may result in the bowstring being directly in front of the location where the body 30 is mounted to the riser 14 while another bow configuration may result in the bowstring being offset to one side from the location where the body 30 is mounted to the riser 14. The embodiment of the bowstring suppression device 20 shown in FIG. 1 may be used in the first situation, but not the second. However, the embodiment of the bowstring suppression device 20 shown in FIGS. 18-23 may be used in either situation by simply rotating the body 30 until the cushion portion 32 is aligned with the bowstring 22.

The bowstring suppression device 20 shown in FIGS. 18-23 is similar or identical to the bowstring suppression device 20 shown in FIG. 1 except that the coupler 34 has been replaced with a coupler or connector 234, a seating member 238, and a fastener 236. The seating member 238 is configured to be coupled to the bottom of the cushion portion 32 using adhesives or any other suitable technique or fastener. The seating member 238 includes a recess 244 that receives a projection 246 on the bottom of the cushion portion 32 and a centrally placed hole that receives a bushing 240. The bushing 240 is configured to receive the fastener 236. In one embodiment, the bushing 240 and the fastener 236 may each be threaded so that the fastener 236 can be securely received in the bushing 240.

The position of the cushion portion 32 can be adjusted as follows. The body 30 is initially loosened and turned until the cushion portion 32 is in line with the bowstring 22. The body 30 is then fixed in place. Since the cushion portion 32 has been rotated, the channel 44 is no longer aligned with the bowstring 22. The channel 44 is aligned by loosening the fastener 236 and turning the cushion portion 32 until the channel 44 is aligned with the bowstring 22 then tightening the fastener 236.

It should be appreciated that the bowstring suppression device 20 may be modified in any of a number of suitable ways. For example, in one embodiment, the first holes 46 and/or the second holes 48 may be configured to extend all of the way through the cushion portion 32. In another embodiment, the cushion portion 32 may include additional holes besides those shown in the FIGS.

Figure 10:
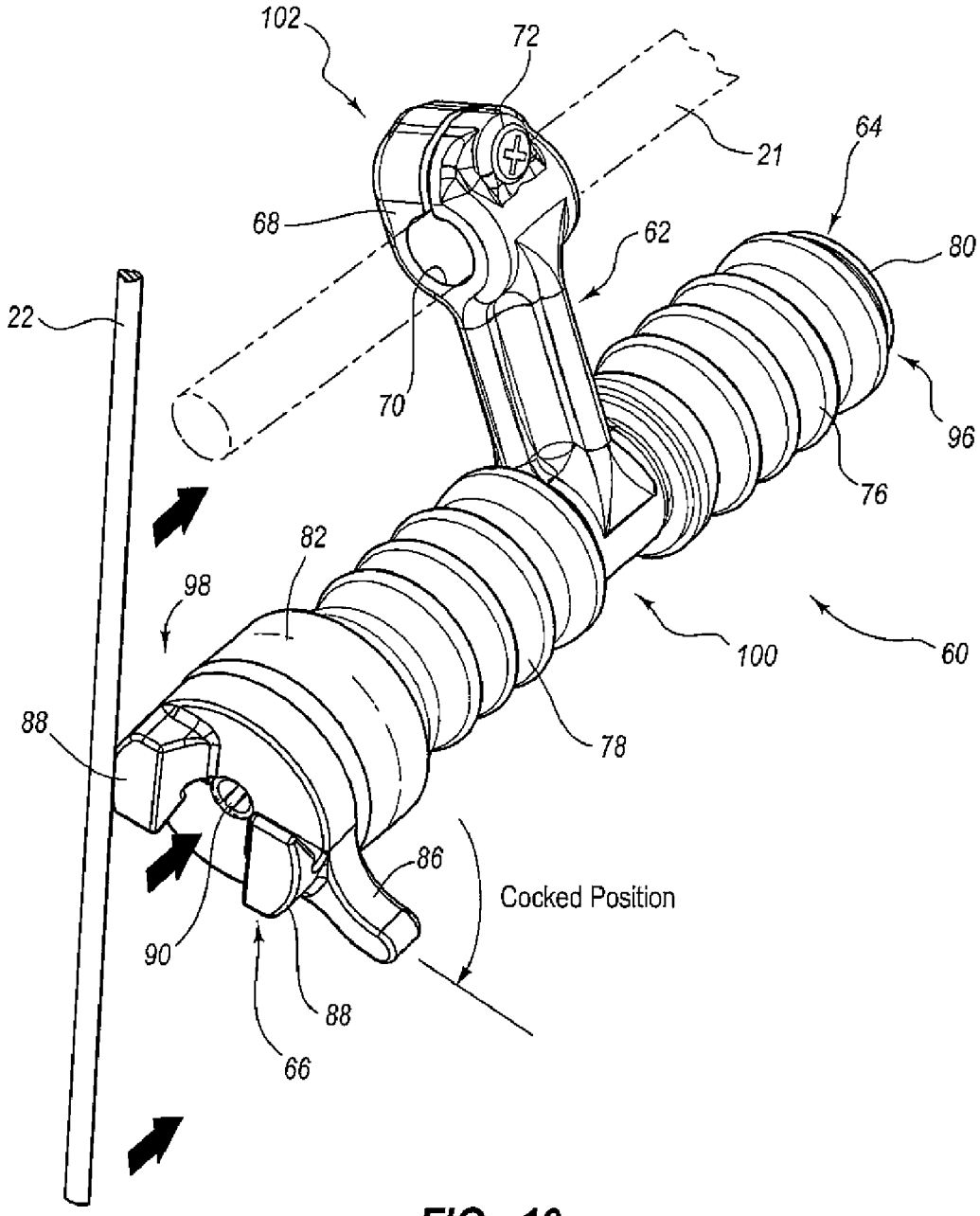
FIG. 10 is a perspective view of another embodiment of a bowstring suppression device in a cocked position.
Figure 24:
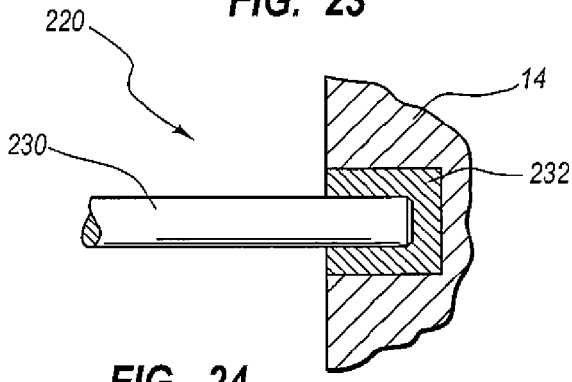
FIG. 24 shows another embodiment of a bowstring suppression device that is mounted to a cushion portion included as part of the bow.

Another embodiment of a bowstring suppression device 220 is shown in FIG. 24. In this embodiment, the body 230 of the bowstring suppression device 220 is coupled to a cushion portion 232 of the bow 10. The bowstring suppression device 220 in this embodiment may be configured similarly to the bowstring suppression device 20. Also, the materials used to form the cushion portion 232 may be similar to the materials used to form the cushion portion 32. The cushion portion 232 serves to further deaden vibration caused by the bowstring 22. If the cushion portion 232 is used, the cushion portion 32 may not be needed and could be replaced with a hard surface. However, it is more desirable to use both cushion portions 32, 232 to further deaden the noise generated by the bowstring 22. As shown in FIG. 10, the cushion portion 232 may be coupled to or part of the riser 14. It should be appreciated that the cushion portion 232 may also be included as part of any other component of the bow 10 such as the limbs 16 or cable guard bar 21.

Referring to FIGS. 10-17, another embodiment of a bowstring suppression device 60 (alternatively referred to herein as a bowstring stop, bowstring suppression apparatus, sound dampening device, or sound dampening apparatus) is shown. In this embodiment, the bowstring suppression device 60 not only absorbs the impact of the bowstring 22 but also captures and holds the bowstring 22 to further dampen residual movement of the bowstring 22. As shown in the FIGS., the bowstring suppression device 60 includes a mounting assembly 62, a body 64, and a stop portion 66 (alternatively referred to herein as a cushion portion, cushion member, stop member, bowstring suppression member, or bowstring arrester). The body 64 has a first end 96 and a second end 98, and the mounting assembly 62 has a first end 100 and a second end 102. The body 64 is coupled to the first end 100 of the mounting assembly 62 so that the body 64 is positioned transverse to the mounting assembly 62. The stop portion 66 is coupled at the second end 98 of the body 64.

Figure 11:
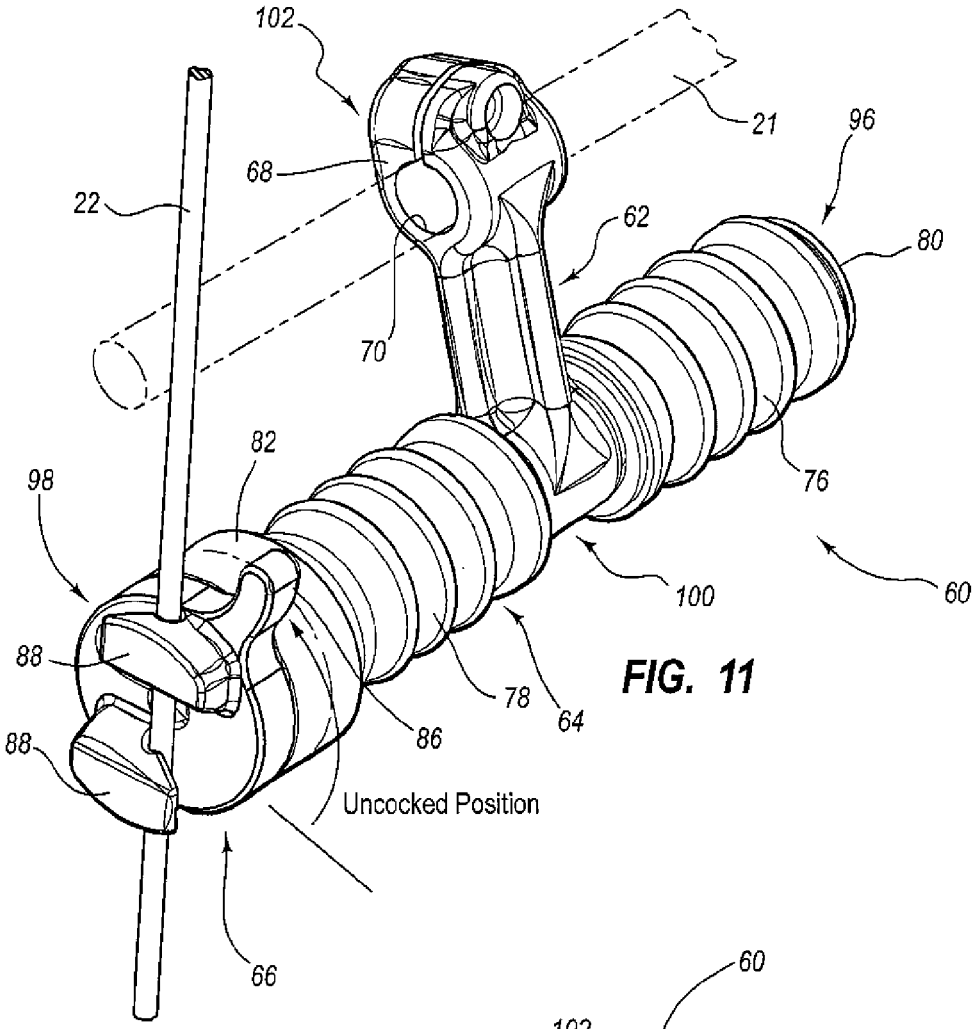
FIG. 11 is a perspective view of the bowstring suppression device from FIG. 10 in an uncocked position.
Figure 12:
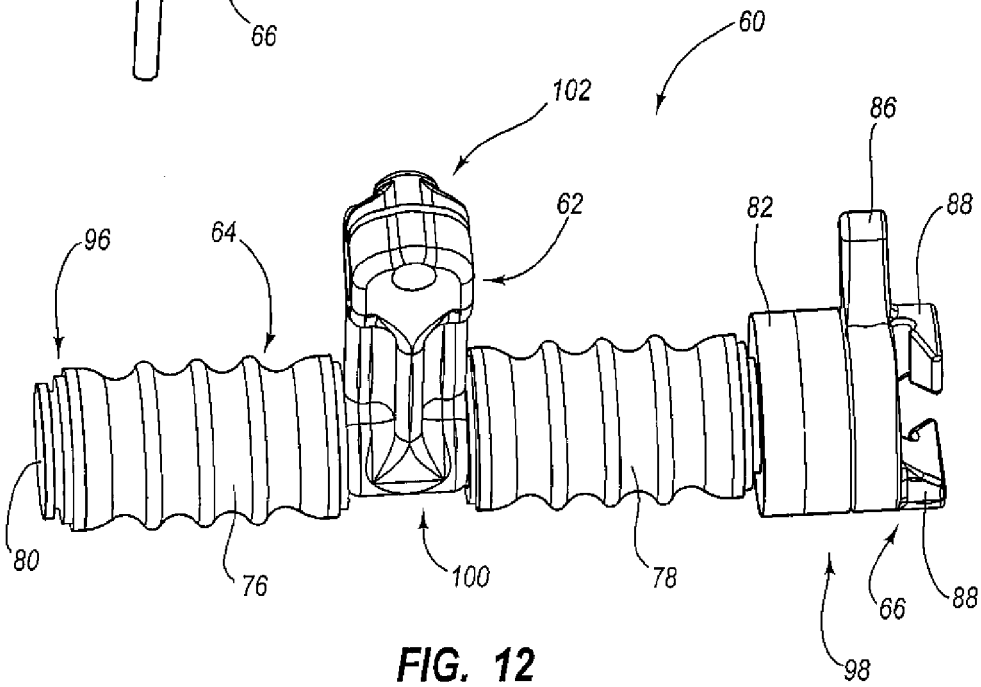
FIG. 12 is a side perspective view of the bowstring suppression device from FIG. 10.

The operation of the bowstring suppression device 60 is illustrated in FIGS. 10-11. FIG. 10 shows the stop portion 66 in a cocked position where it is ready to receive the impact of the bowstring 22. Upon impact with the bowstring 22, the stop portion 66 is configured to rotate as shown in FIG. 11 to capture and hold the bowstring 22. In one embodiment, the stop portion 66 includes prongs 88 that extend upward from the face of the stop portion 66 and also extend tangentially to the stop portion 66 in a direction that is parallel to each other. Thus, when the stop portion 66 is in the cocked position, as shown in FIG. 10, the prongs 88 are spaced apart and positioned parallel to each other and the bowstring 22. The bowstring 22 impacts the stop portion 66 in an area that is between the prongs 88. Upon impact, the stop portion 66 rotates so that the prongs 88 are positioned perpendicular to the bowstring 22 thereby holding the bowstring 22. Once movement of the bowstring 22 has ceased, the bowstring suppression device 60 can be recocked using the tab 86 that extends from the side of the stop portion 66.

The components of the bowstring suppression device 60 are as follows. The mounting assembly 62 includes a mounting member or mounting bracket 68 configured to be coupled to the cable guard assembly 19. In one embodiment, the mounting member 68 has an open 70 at the second end 102 that is sized to receive the rod 21 from the cable guard assembly 19. The mounting bracket 68 is configured to be secured to the rod 21 using a clamping type fastening mechanism. The position of the mounting member 68 relative to the rod 21 can be adjusted by loosening the fastener 72 and moving the mounting member 68 lengthwise along the rod 21. Once the mounting member 68 is in a desired position, the fastener 72 may be tightened to securely hold the bowstring suppression device 60 to the cable guard assembly 19. It should be appreciated that the bowstring suppression device 60 may be coupled to the cable guard assembly 19 in any suitable manner.

Figure 13:
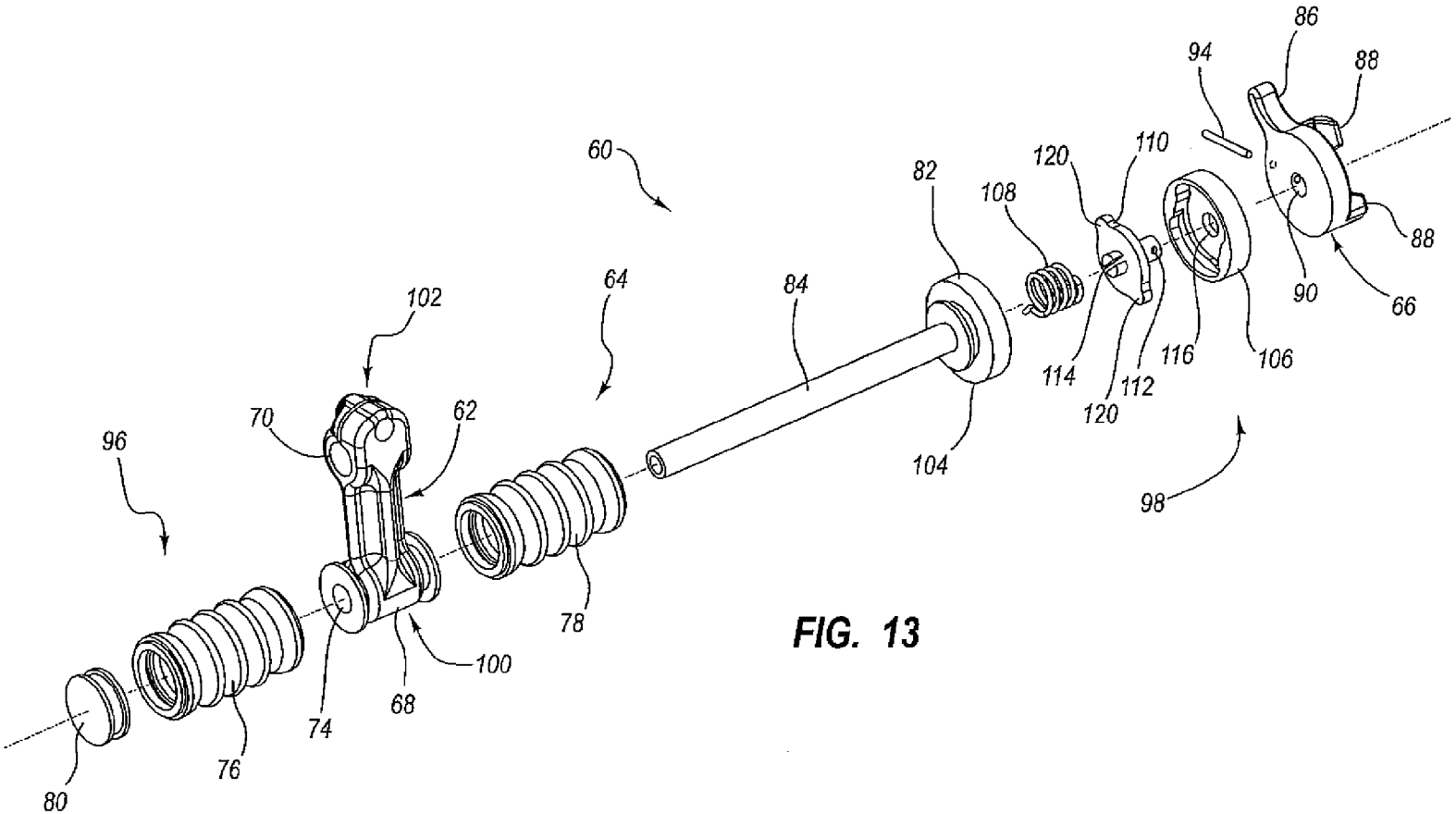
FIGS. 13-14 are exploded perspective views of the bowstring suppression device from FIG. 10.
Figure 14:
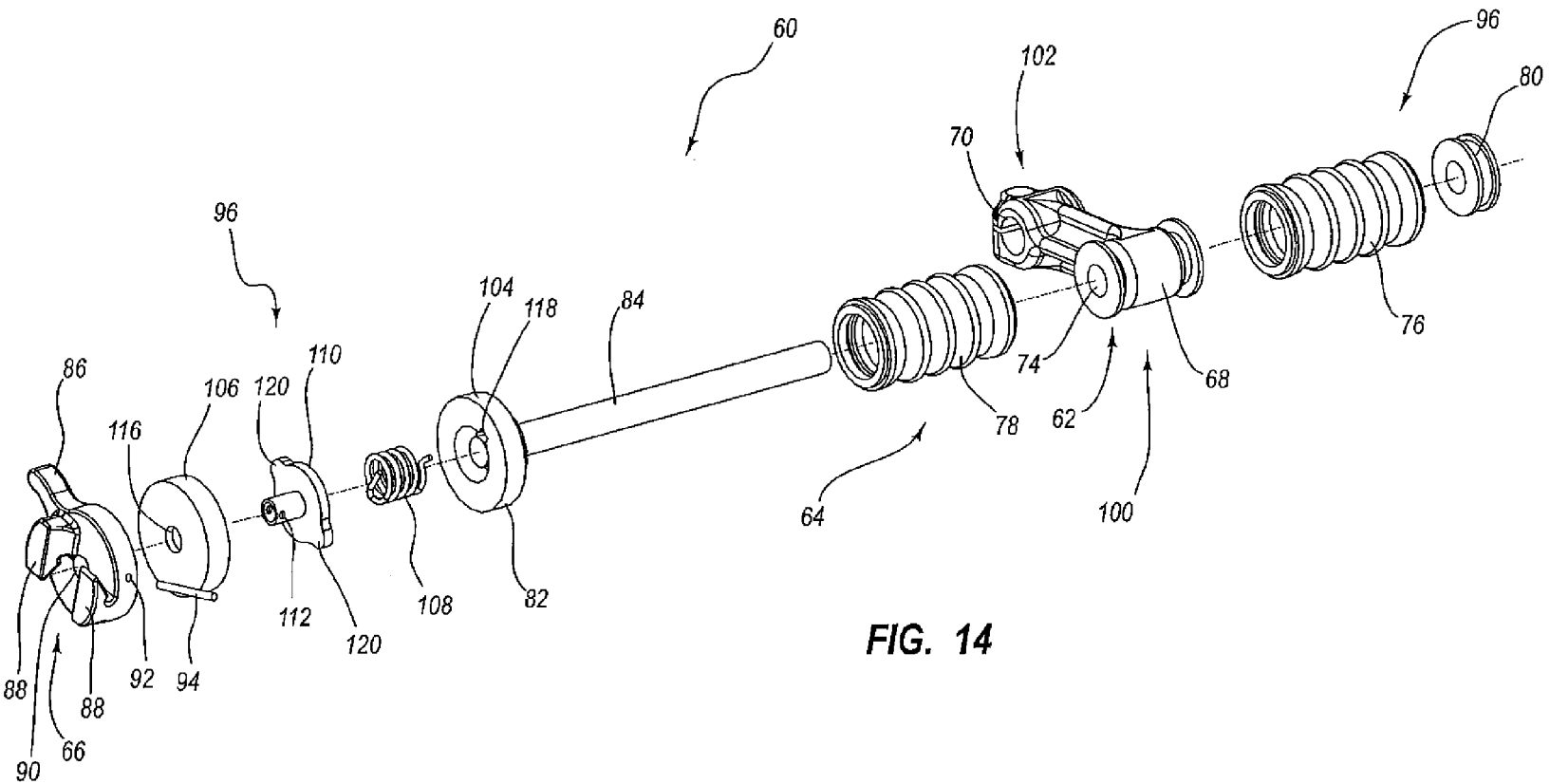

Referring to FIGS. 13 and 14, the body 64 includes a first resilient member, shock absorber, or boot 76 that extends from the mounting member 68 to the first end 96 of the bowstring suppression device 60 and a second resilient member, shock absorber, or boot 78 that extends from the mounting member 68 to the second end 98 of the bowstring suppression device 60. The body 64 also includes an end cap 80, housing 82 and rod 84. When fully assembled, the rod 84 is coupled to the end cap 80 and the housing 82. The mounting member 68 includes an opening 74 at the first end 100 that is sized to receive the rod 84. The resilient members 76, 78 are positioned on each side of the mounting member 68 between the end cap 80 and the housing 82, respectively.

Figure 16:
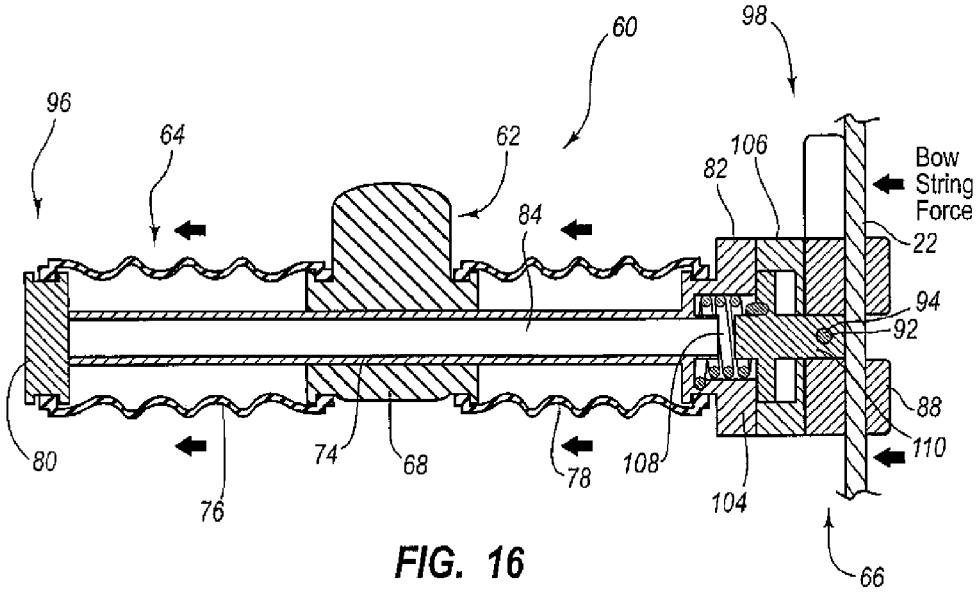
FIG. 16 is a cross-sectional side view of the bowstring suppression device from FIG. 10 in the uncocked position.

In one embodiment, the rod 84 may be configured to slide freely inside the opening 74 of the mounting member 68. Therefore, when the bowstring 22 impacts the bowstring suppression device 60, the rod 84 can move lengthwise back and forth in the opening 74 so that the resilient members 76, 78 can absorb the impact and deaden residual movement of the bowstring 22. FIG. 16 shows how the impact of the bowstring 22 pushes the rod 74 backwards while simultaneously expanding the first resilient member 76 and compressing the second resilient member 78. As the bowstring 22 oscillates after being captured, the resilient members 76, 78 repeatedly expand and contract to deaden residual movement of the bowstring 22. In another embodiment, the rod 84 may be fixed to the mounting member 68 to prevent the body 64 from moving relative to the mounting assembly 62. In this embodiment, the residual movement of the bowstring 22 may be minimized just because the bowstring 22 is being held by the bowstring suppression device 60. It should be appreciated that in either of these embodiments, the stop portion 66 may also be made of resilient materials such as those discussed in connection with the bowstring suppression device 20 to provide an additional dampening effect.

It should be appreciated that the configuration of the bowstring suppression device 60 may be altered in any of a number of ways. For example, the bowstring suppression device 60 is shown in the FIGS as being coupled to the cable guard assembly 19. However, in other embodiments, the bowstring suppression device 60 may be configured to be coupled directly to the riser 14 of the bow 10. Also, it should be appreciated that the bowstring suppression device 60 may be coupled at any suitable location along the riser 14 of the bow 10. It should also be appreciated that, although mounting assembly 62 and the body 64 are shown as being separate components, the mounting assembly 62 and the body 64 may be combined as a single integral component (or split into more than two components).

Referring to FIGS. 13 and 14, the mechanism that rotates the stop portion 66 is shown. The mechanism includes a spring or biasing member 108 and a rotor 110. The housing 82 includes a first housing portion 104 and a second housing portion 106 that are coupled together to hold the spring 103 and the rotor 110. It should be appreciated that the housing portions 104, 106 can be coupled together using any suitable technique or device, including adhesives, welding, threading, or fasteners. The housing 82, in general, is fixed to the rod 84 so that the housing 82 does not move or rotate with the stop portion 66. The rotor 110, on the other hand, is coupled to the stop portion 66 so that the rotor 110 rotates with the stop portion 66. In one embodiment, the rotor 110 includes a shaft portion that is configured to be received by the hole 90 in the stop portion 66. The rotor 110 may be coupled to the stop portion 66 by aligning hole 92 in the stop portion 66 and hole 112 in the rotor 110 and inserting pin 94 through the holes 92, 112.

Figure 17:
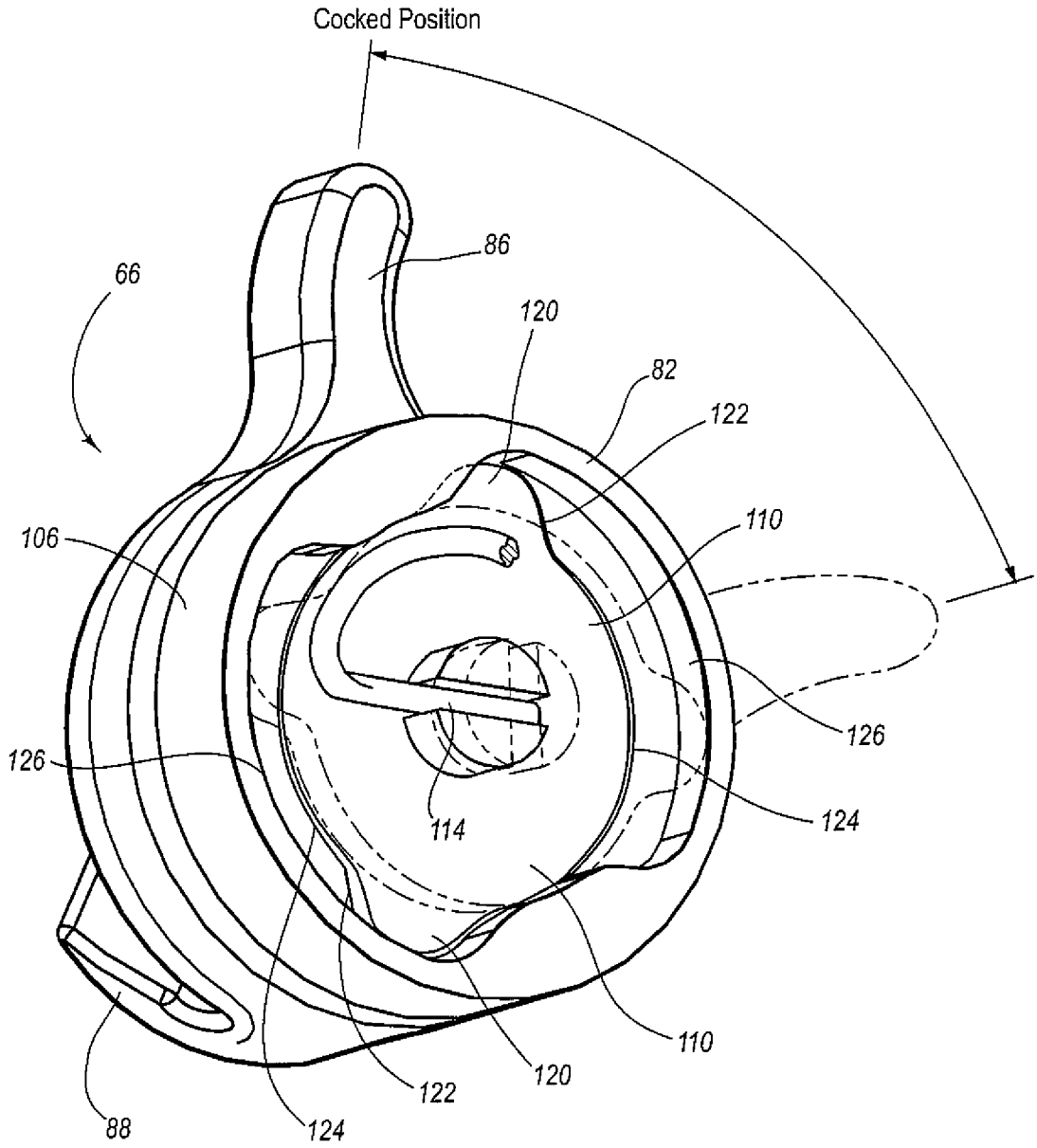
FIG. 17 is the interior of the stop portion of the bowstring suppression device from FIG. 10.
Figure 18:
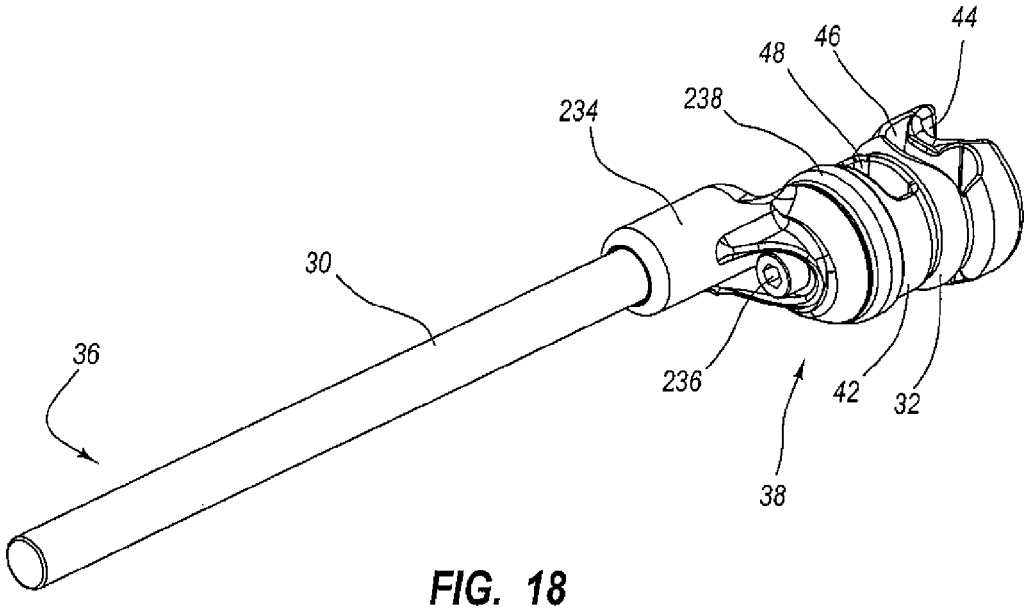
FIGS. 18-19 are perspective views of another embodiment of a bowstring suppression device that can be adjusted to accommodate different lateral bowstring positions.
Figure 19:
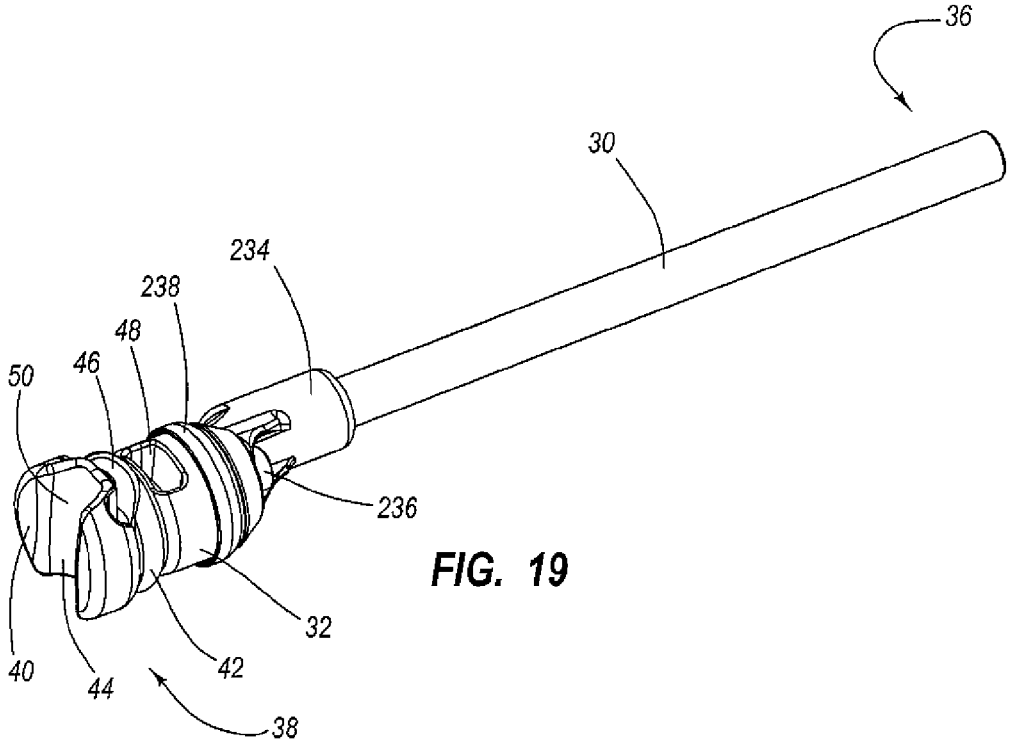
Figure 20:
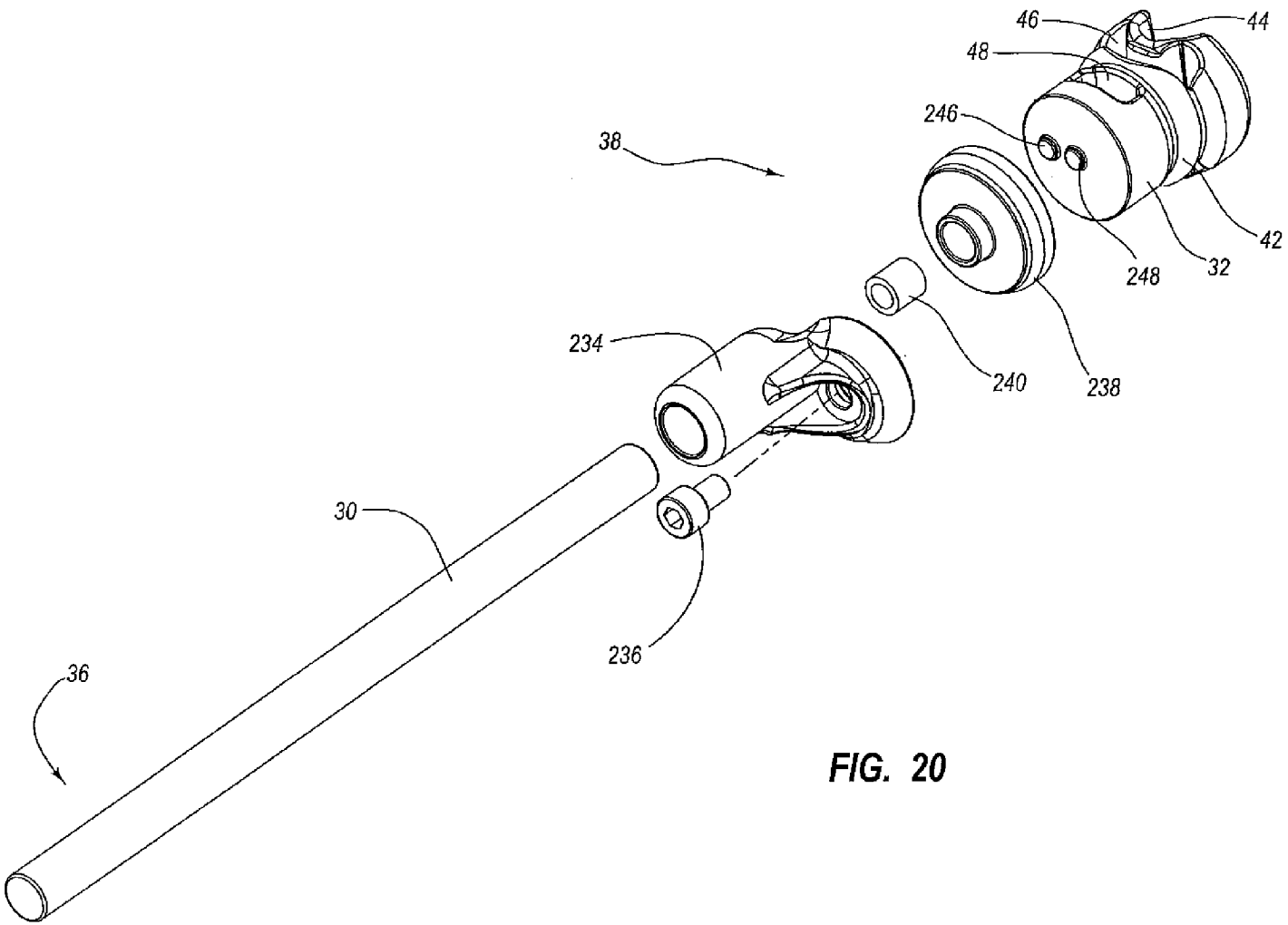
FIG. 20 is an exploded perspective view of the bowstring suppression device from FIGS. 18-19.
Figure 21:
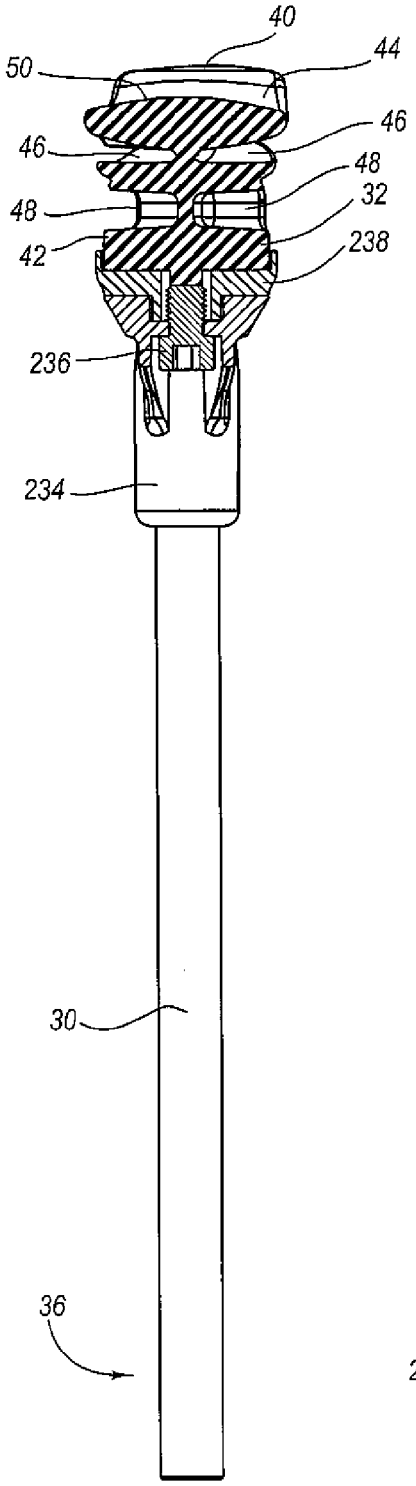
FIG. 21 is a cross-sectional view of the bowstring suppression device from FIGS. 18-19.
Figure 22:
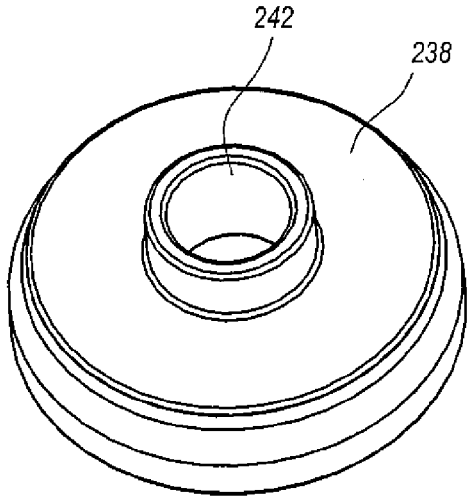
FIGS. 22-23 are perspective views of a coupler used with the bowstring suppression device from FIGS. 18-19.
Figure 23:
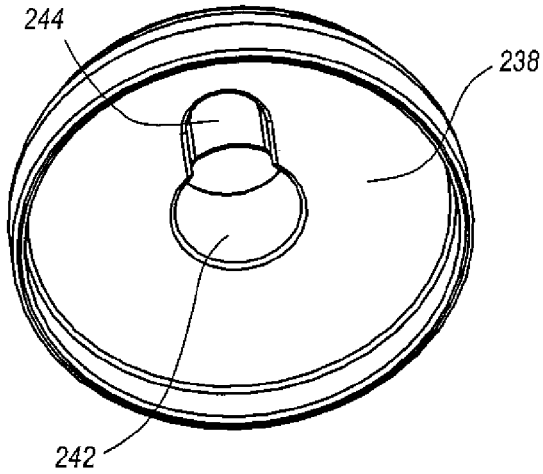

Turning to FIG. 17, the second housing portion 106 includes a smaller inner diameter portion 124 and a larger outer diameter portion 126. The inner diameter portion 124 includes recesses 122 that are configured to receive tabs 120 on the rotor 110. The spring 108 is configured to bias the rotor 110 toward the inner diameter portion 124. When the tabs 120 of the rotor 110 are aligned with the recesses 122, the spring 108 biases the rotor 110 into the inner diameter portion 124.

The bowstring suppression device 60 is in the cocked position when the tabs 120 and the recesses 122 are aligned and the rotor 110 is in the inner diameter portion 124 of the second housing portion 106. The spring 108 is coupled to the rotor at slot 114 and to the first housing portion 104 at recess 118. The spring 108 is twisted to provide a torsion force on the rotor 110 so that if the tabs 120 come out of the recesses 122, the rotor 110 would immediately turn inside the outer diameter portion 126 until the tabs 120 contact the indentations in the outside diameter portion 126. The stop portion 66 rotates with the rotor 110. Thus, the spring 108 is used to both bias the rotor into the inner diameter portion 124 and to turn the rotor 110 when the rotor 110 is in the outer diameter portion 126.

In operation, the force of the bowstring 22 impacting the stop portion 66 pushes the rotor 110 toward the outer diameter portion 126 until the tabs 120 of the rotor 110 clear the recesses 122 in the inner diameter portion and the rotor 110. Now that the tabs 120 of the rotor 110 are out of the recesses 122 in the inner diameter portion 124, the rotor 110 is able to freely rotate in the outer diameter portion 126 of the second housing portion 106. This causes the stop portion 66 to rotate from the cocked position to the uncocked position and to thereby capture and hold the bowstring 22.

Figure 15:
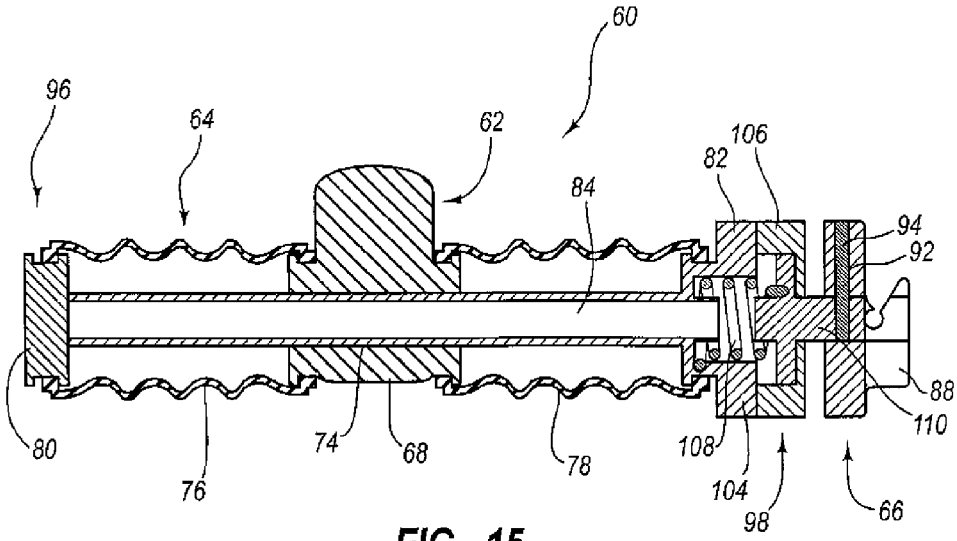
FIG. 15 is a cross-sectional side view of the bowstring suppression device from FIG. 10 in the cocked position.

Referring to FIGS. 15 and 16, movement of the stop portion 66 and the rotor 110 is illustrated. FIG. 15 shows a cross-sectional view of the stop portion 66 shortly before the bowstring 22 impacts the stop portion 66. As shown in FIG. 15, there is a gap between the stop portion 66 and the second housing portion 106. When the bowstring 22 impacts the stop portion 66, the bowstring 22 pushes the stop portion 66 towards the second housing portion 106 so that there is no longer a gap between the stop portion 66 and the second housing portion 106.

It should be appreciated that the bowstring suppression device 60 may be varied in any of a number of ways. For example, in one embodiment, it is contemplated that the components of the bowstring suppression device 60 are made from hard plastics, metals (aluminum), composites, and the like. The bowstring suppression device 60 may also be made from a number of noise reducing materials to ensure that the rotation of the stop portion 66 and the capture of the bowstring 22 is very quiet. Resilient materials such as NAVCOM may be used to cushion impact areas (e.g., coat the tabs 120 of the rotor 110) and/or otherwise dampen sound generated by the rotation of the stop portion 66.

ILLUSTRATIVE EMBODIMENTS

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.)

from the particular embodiments explained below. Accordingly, any combination of any of the subject matter described herein is contemplated.

According to one embodiment, a bowstring suppression device comprises: a first end configured to be coupled to a bow; a second end positioned opposite the first end; a cushion portion positioned at the second end of the bowstring suppression device, the cushion portion being configured to contact a bowstring after the bowstring has been drawn and released to thereby deaden residual movement of the bowstring; wherein the cushion portion includes a hole in a side of the cushion portion to cushion contact between the bowstring and the bowstring suppression device. The hole may be a cavity in the side of the cushion portion. The cushion portion may include at least two holes in the side of the cushion portion to cushion contact between the bowstring and the bowstring suppression device, the at least two holes being positioned opposite each other. The cushion portion may include at least two holes in the side of the cushion portion, the at least two holes being positioned underneath where the bowstring contacts the front section. The cushion portion may include a mixture of chloroprene and butyl polymers. The hole may be a first hole, the cushion portion may include a second hole in the side of the cushion portion, and wherein the first hole and the second hole are positioned on the side of the cushion portion to be generally parallel to a lengthwise axis of the bowstring suppression device. The cushion portion may include a channel, the bowstring suppression device being configured so that the bowstring is aligned with and contacts the channel. The cushion portion may include an impact surface where the bowstring contacts the cushion portion, the impact surface being curved outward.

According to another embodiment, a bow comprises: a bowstring that extends between opposing limbs of the bow; a bowstring stop coupled to the bow so that the bowstring stop extends outward from the bow towards the bowstring, the bowstring stop including a cushion portion positioned to contact the bowstring after the bow has been drawn and released to thereby deaden residual movement of the bowstring; wherein the cushion portion includes a hole in a side of the cushion portion to cushion contact between the bowstring and the bowstring stop. The cushion portion may be positioned at approximately the same position as the bowstring when the bow is in an undrawn position. The hole may be a cavity in the side of the cushion portion. The cushion portion may include at least two holes in the side of the cushion portion to cushion contact between the bowstring and the bowstring stop, the at least two holes being positioned opposite each other. The cushion portion may include at least two holes in the side of the cushion portion, the at least two holes being positioned underneath where the bowstring contacts the front section. The cushion portion may include a mixture of chloroprene and butyl polymers. The hole may be a first hole, the cushion portion including a second hole in the side of the cushion portion, and wherein the first hole and the second hole are positioned on the side of the cushion portion to be generally parallel to a lengthwise axis of the bowstring suppression device. The cushion portion may include a channel, the bowstring stop being positioned so that the bowstring is aligned with the channel and contacts the channel after the bow has been drawn and released. The cushion portion may include an impact surface where the bowstring contacts the cushion portion, the impact surface being curved outward.

According to another embodiment, a bowstring stop comprises: a cushion portion positioned at one end of the bowstring stop, the cushion portion including a front section configured to contact a bowstring after the bow has been drawn and released to thereby deaden residual movement of the bowstring; wherein another end of the bowstring stop positioned opposite the one end is configured to be coupled to a bow; and wherein the front section is unsupported on opposing sides of the cushion portion that are underneath where the bowstring contacts the front section. The cushion portion may include holes in the opposing sides of the cushion portion where the front section is unsupported. The front section may be supported on opposing sides of the cushion portion that are parallel to where the bowstring contacts the front section. The front section may include an impact surface where the bowstring contacts the front section, the impact surface being curved outward.

According to another embodiment, a bow comprises: a bowstring that extends between opposing limbs of the bow; a bowstring suppression device coupled to the bow so that the bowstring suppression device extends outward from the bow towards the bowstring, the bowstring suppression device including a cushion portion having a front section positioned to contact the bowstring after the bow has been drawn and released to thereby deaden residual movement of the bowstring; wherein the front section is unsupported on opposing sides of the cushion portion that are underneath where the bowstring contacts the front section. The cushion portion may include holes in the opposing sides of the cushion portion where the front section is unsupported. The front section may be supported on opposing sides of the cushion portion that are parallel to where the bowstring contacts the front section. The front section may include an impact surface where the bowstring contacts the front section, the impact surface being curved outward.

According to another embodiment, a bowstring stop comprises: a cushion portion positioned at one end of the bowstring stop, the cushion portion being configured to contact a bowstring after the bow has been drawn and released to thereby deaden residual movement of the bowstring; wherein another end of the bowstring stop positioned opposite the one end is configured to be coupled to a bow; and wherein the cushion portion includes an impact surface where the bowstring contacts the cushion portion, the impact surface being curved outward. The cushion portion may include a channel, the impact surface being positioned in the channel. The impact surface may be unsupported on opposing sides of the cushion portion that are underneath the impact surface. The cushion portion may include at least two holes to cushion contact between the bowstring and the bowstring stop, the at least two holes being positioned opposite each other underneath the impact portion.

According to another embodiment, a bow comprises: a bowstring that extends between opposing limbs of the bow; a bowstring stop coupled to the bow so that the bowstring stop extends outward from the bow towards the bowstring, the bowstring stop including a cushion portion positioned to contact the bowstring after the bow has been drawn and released to thereby deaden residual movement of the bowstring; wherein the cushion portion includes an impact surface where the bowstring contacts the cushion portion, the impact surface being curved outward toward the bowstring. The cushion portion may include a channel, the impact surface being positioned in the channel. The impact surface may be unsupported on opposing sides of the cushion portion that are underneath the impact surface. The cushion portion may include at least two holes to cushion contact between the bowstring and the bowstring stop, the at least two holes being positioned opposite each other underneath the impact portion.

Accordingly, a bowstring suppression device comprises: a first end configured to be coupled to a bow; a second end positioned opposite the first end; a cushion portion positioned at the second end of the bowstring suppression device, the cushion portion being configured to contact a bowstring after the bow has been drawn and released to thereby deaden residual movement of the bowstring; wherein the cushion portion includes a mixture of chloroprene and butyl polymers. The bowstring suppression device may be configured to be coupled to a riser of the bow. The cushion portion may include a channel, the bowstring suppression device being configured so that the bowstring is aligned with and contacts the channel. The cushion portion includes an impact surface where the bowstring contacts the cushion portion, the impact surface being curved outward. The cushion portion may include at least two holes, the at least two holes being positioned underneath where the bowstring contacts the cushion portion.

According to another embodiment, a bow comprises: a bowstring that extends between opposing limbs of the bow; a bowstring stop coupled to the bow so that the bowstring stop extends rigidly outward from the bow towards the bowstring, the bowstring stop including a cushion portion positioned to contact the bowstring after the bow has been drawn and released to thereby deaden residual movement of the bowstring; wherein the cushion portion includes a mixture of chloroprene and butyl polymers. The cushion portion may be positioned at approximately the same position as the bowstring when the bow is in an undrawn position. The bow comprise a riser coupled to each of the opposing limbs, wherein the bowstring stop is coupled to the riser. The cushion portion may include a channel, the bowstring suppression device may be positioned so that the bowstring is aligned with the channel and contacts the channel after the bow has been drawn and released. The cushion portion may include an impact surface where the bowstring contacts the cushion portion, the impact surface being curved outward. The cushion portion may include at least two holes, the at least two holes may be positioned underneath where the bowstring contacts the cushion portion.

According to another embodiment, a bowstring stop comprises: a cushion portion positioned at one end of the bowstring stop, the cushion portion including a front section configured to contact a bowstring after the bow has been drawn and released to thereby deaden residual movement of the bowstring; wherein another end of the bowstring stop positioned opposite the one end is configured to be coupled to a bow; and wherein the cushion portion includes a weak spot in a side of the cushion portion to cushion contact between the bowstring and the bowstring stop. The weak spot may be formed of material that deforms much easier than material used to form the remainder of the cushion portion. The weak spot is a cavity. The cushion portion may include at least two holes in the side of the cushion portion to cushion contact between the bowstring and the bowstring stop, the at least two holes being positioned opposite each other. The cushion portion may include a channel, the bowstring stop may be configured so that the bowstring is aligned with and contacts the channel. A bottom of the channel may be curved outward. The weak spot may be a first weak spot, the cushion portion may include a second weak spot in the side of the cushion portion, and wherein the first weak spot and the second weak spot may be positioned on the side of the cushion portion to be generally parallel to a lengthwise axis of the bowstring stop.

According to another embodiment, a bow comprises: a bowstring that extends between opposing limbs of the bow; a bowstring stop coupled to the bow so that the bowstring stop extends outward from the bow towards the bowstring, the bowstring stop including a cushion portion having a front section positioned to contact the bowstring after the bow has been drawn and released to thereby deaden residual movement of the bowstring; wherein the cushion portion includes a weak spot in a side of the cushion portion to cushion contact between the bowstring and the bowstring stop. The weak spot may be formed of material that deforms much easier than material used to form the remainder of the cushion portion. The weak spot may be a cavity. The cushion portion may include at least two holes in the side of the cushion portion to cushion contact between the bowstring and the bowstring stop, the at least two holes being positioned opposite each other. The cushion portion may include a channel, the bowstring stop being positioned so that the bowstring is aligned with the channel and contacts the channel after the bow has been drawn and released. A bottom of the channel may be curved outward. The weak spot may be a first weak spot, the cushion portion may include a second weak spot in the side of the cushion portion, and wherein the first weak spot and the second weak spot may be positioned on the side of the cushion portion to be generally parallel to a lengthwise axis of the bowstring stop.

According to another embodiment, a bowstring suppression apparatus comprises: a stop portion positioned at one end of the bowstring suppression apparatus, the stop portion including a mixture of chloroprene and butyl polymers; wherein another end of the bowstring suppression apparatus positioned opposite the one end is configured to be coupled to a bow; and wherein the stop portion is configured to contact the bowstring after the bow has been drawn and released to thereby obstruct residual movement of the bowstring.

According to another embodiment, a bowstring stop comprises: a stop portion positioned at one end of the bowstring stop, the stop portion including a mixture of chloroprene and butyl polymers; wherein another end of the bowstring stop positioned opposite the one end is configured to be coupled to a bow; and wherein the stop portion is configured to contact the bowstring after the bow has been drawn and released to thereby impede residual movement of the bowstring.

According to another embodiment, a bowstring suppression device comprises: a stop portion positioned at one end of the bowstring stop, the stop portion being rotatable to hold a bowstring of a bow after the bowstring has been released to thereby deaden residual movement of the bowstring. The bowstring suppression device may be configured to be coupled to a cable guard of the bow. The stop portion may include at least two prongs that hold the bowstring. The bowstring suppression device may include a spring positioned to apply a torsion force to the stop portion to thereby rotate the stop member. The bowstring suppression device may include a body and wherein the stop portion may be configured to move towards the body when the bowstring impacts the stop portion thereby facilitating rotation of the stop portion to hold the bowstring. A bow may comprise: the bowstring extending between opposing limbs of the bow; and the bowstring suppression device coupled to the bow so that the bowstring is configured to impact the stop portion when the bow is drawn and released.

According to another embodiment, a bowstring suppression device comprises: a stop portion positioned at one end of the bowstring stop, the stop portion being configured to hold a bowstring of a bow after the bowstring has been released to thereby deaden residual movement of the bowstring; wherein the stop portion is actuated to hold the bowstring by the impact of the bowstring with the stop portion. The bowstring suppression device may be configured to be coupled to a cable guard of the bow. The stop portion may include at least two prongs that hold the bowstring. The bowstring suppression device may include a spring positioned to apply a torsion force to the stop portion to thereby rotate the stop member. The bowstring suppression device may include a body and wherein the impact of the bowstring with the stop portion may move the stop portion towards the body thereby facilitating rotation of the stop portion to hold the bowstring. A bow may comprise: the bowstring extending between opposing limbs of the bow; and the bowstring suppression device coupled to the bow so that the bowstring is configured to impact the stop portion when the bow is drawn and released.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A bowstring suppression device comprising:

a first end configured to be coupled to a bow;

a second end positioned opposite the first end;

a cushion portion positioned at the second end of the bowstring suppression device, the cushion portion being configured to contact a bowstring after the bow has been drawn and released to thereby deaden residual movement of the bowstring;

wherein the cushion portion includes a hole in a side of the cushion portion to cushion contact between the bowstring and the bowstring suppression device, wherein at least a portion of the hole at least partially collapses when the bowstring contacts the cushion portion.

2. The bowstring suppression device of claim 1 wherein the hole is a cavity in the side of the cushion portion.

3. The bowstring suppression device of claim 1 wherein the cushion portion includes at least two holes in the side of the cushion portion to cushion contact between the bowstring and the bowstring suppression device, the at least two holes being positioned opposite each other.

4. The bowstring suppression device of claim 1 wherein the cushion portion includes at least two holes in the side of the cushion portion, the at least two holes being positioned underneath where the bowstring contacts the front section.

5. The bowstring suppression device of claim 1 wherein the cushion portion includes a mixture of chloroprene and butyl polymers.

6. The bowstring suppression device of claim 1 wherein the hole is a first hole, the cushion portion including a second hole in the side of the cushion portion, and wherein the first hole and the second hole are positioned on the side of the cushion portion to be generally parallel to a lengthwise axis of the bowstring suppression device.

7. The bowstring suppression device of claim 1 wherein the cushion portion includes a channel, the bowstring suppression device being configured so that the bowstring is aligned with and contacts the channel.

8. The bowstring suppression device of claim 1 wherein the cushion portion includes an impact surface where the bowstring contacts the cushion portion, the impact surface being curved outward.

9. The bowstring suppression device of claim 1 wherein the cushion portion is configured to grip the bowstring for one or more cycles.

10. A bow comprising:

the bowstring referred to in claim 1, the bowstring extending between opposing limbs of the bow; and the bowstring suppression device of claim 1 coupled to the bow so that the bowstring suppression device extends outward from the bow towards the bowstring.

11. A bowstring stop comprising:

a cushion portion positioned at one end of the bowstring stop, the cushion portion including a front section configured to contact a bowstring after the bowstring has been released to thereby deaden residual movement of the bowstring, and at least one cavity defined in the cushion portion;

wherein another end of the bowstring stop positioned opposite the one end is configured to be coupled to a bow; and wherein the front section is unsupported on opposing sides of the cushion portion that are underneath where the bowstring contacts the front section, wherein the at least one cavity at least partially collapses when the bowstring contacts the front section.

12. The bowstring stop of claim 11 wherein the cushion portion comprises a pair of apertures formed in the opposing sides of the cushion portion where the front section is unsupported.

13. The bowstring stop of claim 11 wherein the front section is supported on opposing sides of the cushion portion that are parallel to where the bowstring contacts the front section.

14. The bowstring stop of claim 11 wherein the front section includes an impact surface where the bowstring contacts the front section, the impact surface being curved outward.

15. A bow comprising:

the bowstring referred to in claim 11, the bowstring extending between opposing limbs of the bow; and the bowstring stop of claim 11 coupled to the bow so that the bowstring stop extends outward from the bow towards the bowstring.

16. A bowstring stop comprising:

a cushion portion positioned at one end of the bowstring stop, the cushion portion being configured to contact a bowstring after the bow has been drawn and released to thereby deaden residual movement of the bowstring;

wherein another end of the bowstring stop positioned opposite the one end is configured to be coupled to a bow; and wherein the cushion portion includes an impact surface where the bowstring contacts the cushion portion, the impact surface being curved outward, and a cavity positioned underneath at least a portion of the impact surface, wherein at least a portion of the cavity at least partially collapses when the bowstring contacts the impact surface.

17. The bowstring stop of claim 16 wherein the cushion portion includes a channel, the impact surface being positioned in the channel.

18. The bowstring stop of claim 16 wherein the impact surface is unsupported on opposing sides of the cushion portion that are underneath the impact surface.

19. The bowstring stop of claim 16 wherein the cushion portion comprises a pair of cavities to cushion contact between the bowstring and the bowstring stop, the pair of cavities being positioned opposite each other underneath the impact portion.

20. A bow comprising:

the bowstring referred to in claim 16, the bowstring extending between opposing limbs of the bow; and the bowstring stop of claim 16 coupled to the bow so that the bowstring stop extends outward from the bow towards the bowstring.

21. A bowstring suppression device comprising:

a first end configured to be coupled to a bow;

a second end positioned opposite the first end;

a cushion portion positioned at the second end of the bowstring suppression device, the cushion portion being configured to contact a bowstring after the bow has been drawn and released to thereby deaden residual movement of the bowstring, the cushion portion including a cavity, at least a portion of the cavity at least partially collapses upon contact of the cushion portion by the bowstring;

wherein the cushion portion includes a mixture of chloroprene and butyl polymers.

22. The bowstring suppression device of claim 21 wherein the bowstring suppression device is configured to be coupled to a riser of the bow.

23. The bowstring suppression device of claim 21 wherein the cushion portion includes a channel, the bowstring suppression device being configured so that the bowstring is aligned with and contacts the channel.

24. The bowstring suppression device of claim 21 wherein the cushion portion includes an impact surface where the bowstring contacts the cushion portion, the impact surface being curved outward.

25. The bowstring suppression device of claim 21 wherein the cushion portion comprises a pair of apertures, the pair of apertures being positioned underneath where the bowstring contacts the cushion portion.

26. A bow comprising:

the bowstring referred to in claim 21, the bowstring extending between opposing limbs of the bow; and the bowstring suppression device of claim 21 coupled to the bow so that the bowstring suppression device extends outward from the bow towards the bowstring.

27. A bowstring suppression device comprising:

a first end configured to be coupled to a bow;

a second end positioned opposite the first end;

a cushion portion positioned at the second end of the bowstring suppression device, the cushion portion being configured to contact a bowstring after the bow has been drawn and released to thereby deaden residual movement of the bowstring;

wherein the cushion portion includes at least two holes in a side of the cushion portion to cushion contact between the bowstring and the bowstring suppression device, the at least two holes being positioned opposite each other.

28. A bowstring suppression device comprising:

a first end configured to be coupled to a bow;

a second end positioned opposite the first end;

a cushion portion positioned at the second end of the bowstring suppression device, the cushion portion being configured to contact a bowstring after the bow has been drawn and released to thereby deaden residual movement of the bowstring;

wherein the cushion portion includes at least two holes in the side of the cushion portion to cushion contact between the bowstring and the bowstring suppression device, the at least two holes being positioned underneath where the bowstring contacts the front section.

29. A bowstring suppression device comprising:

a first end configured to be coupled to a bow;

a second end positioned opposite the first end;

a cushion portion positioned at the second end of the bowstring suppression device, the cushion portion being configured to contact a bowstring after the bow has been drawn and released to thereby deaden residual movement of the bowstring;

wherein the cushion portion includes a first hole in a side of the cushion portion to cushion contact between the bowstring and the bowstring suppression device, and the cushion portion includes a second hole in the side of the cushion portion, wherein the first hole and the second hole are positioned on the side of the cushion portion to be generally parallel to a lengthwise axis of the bowstring suppression device.

30. A bowstring stop comprising:

a cushion portion positioned at one end of the bowstring stop, the cushion portion being configured to contact a bowstring after the bow has been drawn and released to thereby deaden residual movement of the bowstring;

wherein another end of the bowstring stop positioned opposite the one end is configured to be coupled to a bow; and wherein the cushion portion includes an impact surface where the bowstring contacts the cushion portion, the impact surface being curved outward, and includes at least two holes to cushion contact between the bowstring and the bowstring stop, the at least two holes being positioned opposite each other underneath the impact portion.

31. The bowstring stop of claim 29 wherein the cushion portion includes a channel, the impact surface being positioned in the channel.

32. A bowstring suppression device comprising:

a first end configured to be coupled to a bow;

a second end positioned opposite the first end;

a cushion portion positioned at the second end of the bowstring suppression device, the cushion portion being configured to contact a bowstring after the bow has been drawn and released to thereby deaden residual movement of the bowstring;

wherein the cushion portion includes a mixture of chloroprene and butyl polymers, and includes at least two holes, the at least two holes being positioned underneath where the bowstring contacts the cushion portion.

33. The bowstring suppression device of claim 32 wherein the cushion portion includes a channel, the bowstring suppression device being configured so that the bowstring is aligned with and contacts the channel.

34. The bowstring suppression device of claim 32 wherein the cushion portion includes an impact surface where the bowstring contacts the cushion portion, the impact surface being curved outward.

* * * * *